US005229777A

United States Patent [19]

Doyle

[11] Patent Number: 5,229,777

[45] Date of Patent: Jul. 20, 1993

[54] MICROSTRAP ANTENNA

[76] Inventor: David W. Doyle, 920 Meadowbrook Dr., Wylie, Tex. 75098

[21] Appl. No.: 787,250

[22] Filed: Nov. 4, 1991

[51] Int. Cl.[5] ..... H01Q 1/38

[52] U.S. Cl. ..... 343/700 MS; 343/846; 343/770

[58] Field of Search ..... 343/700 MS, 795, 807, 343/829, 846, 767, 770

[56] References Cited

U.S. PATENT DOCUMENTS

| | | | |
|---|---|---|---|
| 4,012,742 | 3/1977 | Johnson | 343/700 MS |
| 4,812,855 | 3/1989 | Coe et al. | 343/700 MS |
| 4,860,019 | 8/1989 | Tiang et al. | 343/807 |

OTHER PUBLICATIONS

Garvin et al., "Missile Base Mounted Microstrip Antennas", IEEE Transactions on Antennas and Propagation, vol. AP-25, No. 5 Sep. 1977, pp. 604-610.

*Primary Examiner*—Rolf Hille
*Assistant Examiner*—Huanganh Le
*Attorney, Agent, or Firm*—Renner, Kenner, Grieve, Bobak, Taylor & Weber

[57] ABSTRACT

A microstrip antenna is provide for radiating a broad bandwidth of input signals. A pair of identical triangular patches are maintained upon a ground plane, with feed pins being connected to conductive planes of the triangular patches at apexes maintained in juxtaposition to each other. Sides of the conductive planes opposite such apexes are grounded and the radiating slots are formed by the other sides adjacent to the apexes and the ground plane. The input signals to the pair of patches are of equal amplitude, but 180° out of phase. The triangular nature of the patches provides a broad range of signal separation such that the resulting microstrip antenna can accommodate a broad range of input signals and radiate the same.

7 Claims, 2 Drawing Sheets

SLOT 21 SLOT 23 SLOT 25 SLOT 27

MICROSTRAP ANTENNA

TECHNICAL FIELD

The invention herein resides in the art of antennas adapted for emitting and transmitting electromagnetic signals. More particularly, the invention relates to the construction of microstrip antennas having a broad bandwidth.

BACKGROUND ART

The use of microstrip or patch antennas for radiating energy is well known. Presently, such microstrip or patch antennas have significant frequency bandwidth limitations. As is well known to those skilled in the art, the radiating slots of such antennas are typically separated by a conductive plane which is approximately one half wavelength wide at the design frequency. It is also known that radiation occurs because of the fringing of fields at the slot boundaries. The field components normal to the conductive plane do not contribute to the radiated pattern, but only the field components parallel to the conductive planes. Since the slots are separated by one half wavelength, the frequency and VSWR bandwidths are limited to a maximum of about twenty percent and typically ten-twelve percent.

In the prior art, the radiating frequency and VSWR are typically set by the physical configuration of the patch which acts as a transmission line to conduct the RF energy from a conductive feed pin to the radiating slots. Where the patch is rectangular as in the prior art, the radiating frequency is relatively fixed. Accordingly, the prior art patch antennas have been characterized by a narrow operating frequency range. This frequency constraint is present not only with rectangular, but also square, circular, and elliptical patches.

The significant band width limitations of existing patch antennas limit their utility. Accordingly, there is a need in the art for patch antennas with increased frequency and VSWR bandwidths over previously existing systems.

DISCLOSURE OF INVENTION

In light of the foregoing, it is a first aspect of the invention to provide a microstrip antenna with increased bandwidth response over the prior art.

Another aspect of the invention is the provision of a microstrip antenna which is self-scaling.

An additional aspect of the invention is the provision of a microstrip antenna in which radiating slots are separated by a variable distance.

Still a further aspect of the invention is the provision of a microstrip antenna which is reliable and durable in operation, and conducive to implementation with state of the art materials.

The foregoing and other aspects of the invention which will become apparent hereinafter are attained by a microstrip antenna, comprising: first and second triangular conductive planes; a ground plane spaced from said conductive planes; a dielectric material interposed between said conductive planes and said ground plane; and wherein radiating slots are formed by said triangular conductive planes and said ground plane.

Other aspects of the invention which will become apparent herein are achieved by a microstrip antenna, comprising: a signal source; a first triangular conductive plane having an apex connected to said signal source; a second triangular conductive plane having an apex connected to said signal source; said first and second triangular conductive planes having respective sides parallel to each other; a ground plane; sides of said conductive planes opposite said apexes being connected to said ground plane; and radiating slots between said triangular conductive planes and said ground plane.

DESCRIPTION OF DRAWINGS

For a complete understanding of the objects, techniques and structure of the invention references should be made to the following detailed description and accompanying drawing wherein.

BEST MODE FOR CARRYING OUT THE INVENTION

Figure 1:
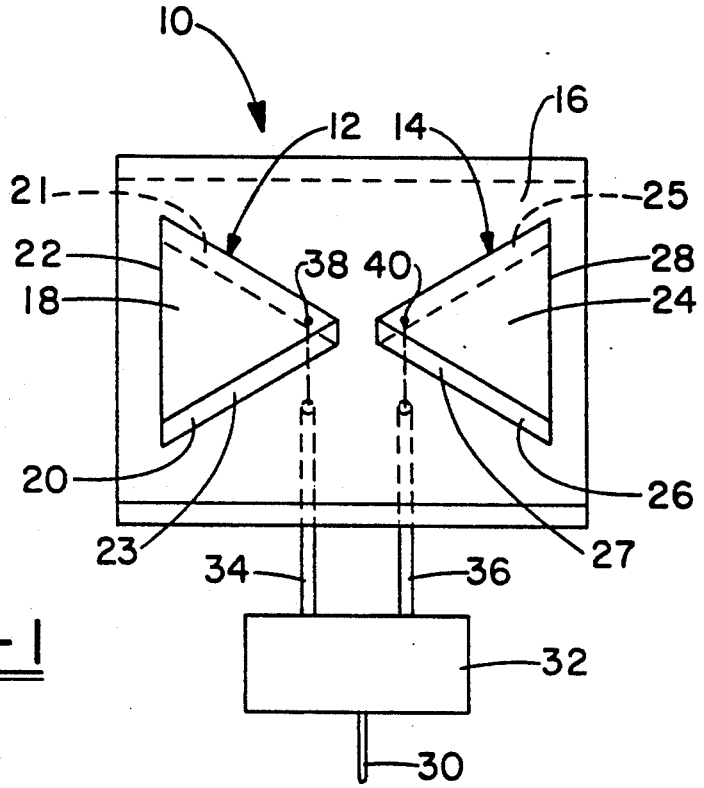
FIG. 1 is a front perspective view of a microstrip antenna according to the invention.

Referring now to the drawings and particularly FIG. 1, it can be seen that a microstrip antenna according to the invention is designated generally by the numeral 10. The antenna 10 comprises a pair of patch antennas 12, 14, both of which are received upon a common ground plane 16. In the preferred embodiment of the invention, the patches 12, 14 are of a triangular shape, each positioned with an apex in juxtaposition to the apex of the other, and aligned such that a line interconnecting such apexes passes through the center points of the side opposite such apexes. In other words, respective sides of the triangular patches would be parallel to each other and the patches themselves would be of equal size, shape, and dimensions.

Figure 2:
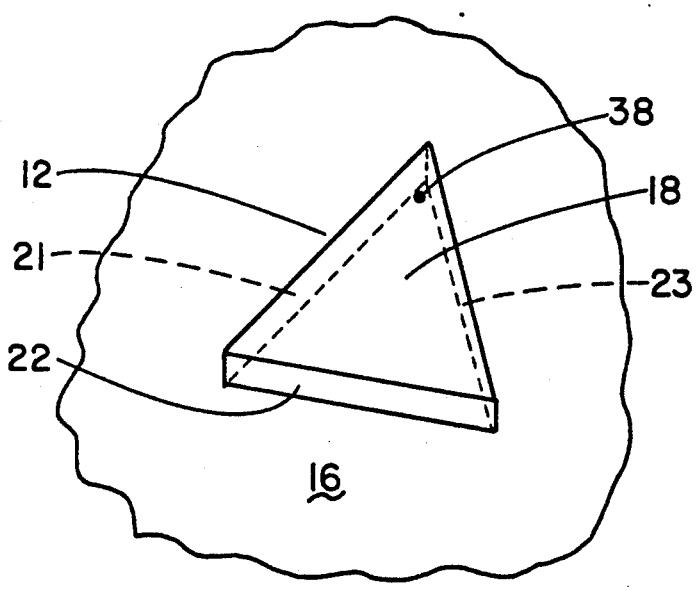
FIG. 2 is a partial sectional view of the microstrip antenna of FIG. 1, showing the interconnection of the radiating plane with a ground plane.

As shown, the patch antenna 12 comprises a conducting plane 18 of copper or other appropriately conductive material, the same being parallel to and spaced from the ground plane 16 by means of an appropriate dielectric layer 20. In a preferred embodiment of the invention, the dielectric comprises a solid teflon fiberglass layer or a composite of teflon fiberglass and honeycomb dielectric layers. As best shown in FIG. 2, a ground plane 22 is connected to a rear edge or side of the conducting plane 18 and extends downwardly there from to interconnection with the ground plane 16. With the ground plane 22 being conducting, it can be seen that the rear edge of the conductive plane 18 is drawn to a ground potential. The radiating slots 23 and 21 comprise the area between the edge of the conducting plane 18 and the ground plane 16.

The patch antenna 14 is constructed in a manner similar to that of the patch 12. Again, a triangular conducting plane 24 is maintained parallel to the ground plane 16 with an appropriate dielectric layer 26 interposed therebetween. A ground plate 28 connects to a rear edge of the conducting plane 24 and extends downwardly to the ground plane 16, pulling the back edge of the conducting plane 24 to a ground potential as well. The radiating slots for this patch antenna are designated by the numerals 25 and 27.

It will be appreciated by those skilled in the art that the total thickness of the microstrip antenna 10, from the top of the conducting planes 18, 24 to the bottom of the ground plane 16 is on the order of 0.031–0.5 inch. It will also be appreciated that the specific included angles of the opposing apexes of the patches 12, 14 may vary to accommodate design criteria, it being preferred however that the patches 12, 14 be substantially identical as to size, shape, dimensions, and materials.

Figure 3:
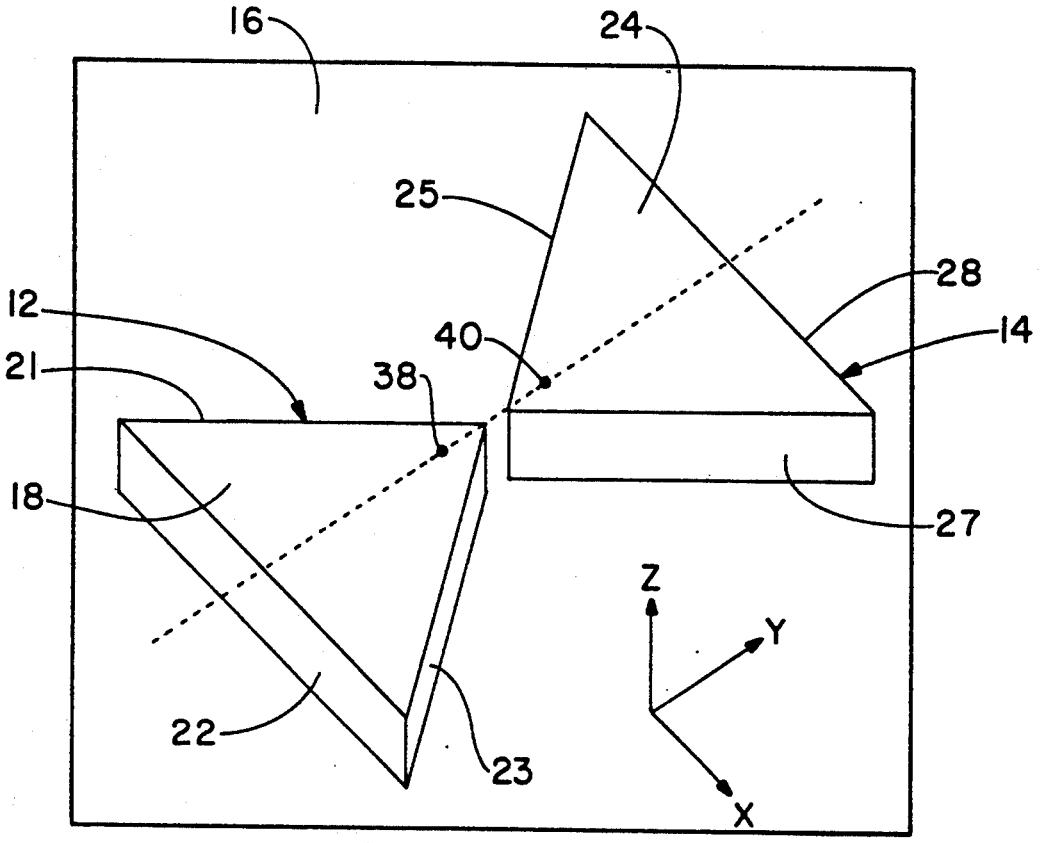
FIGS. 3A-3D are perspective views of the microstrip antenna of FIG. 1, showing a coordinate system and the electric field distribution in the slots.
Figures 3A, 3B, 3C, 3D:
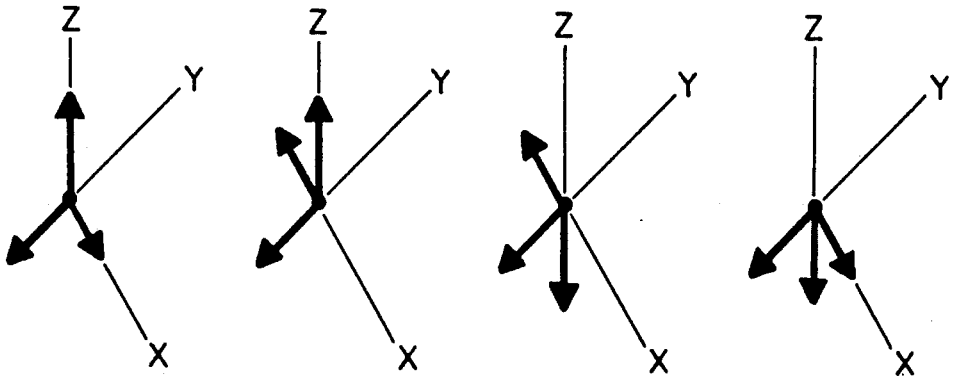

An input cable 30 provides an input signal to the microstrip antenna 10. The cable 30 feeds a "balun" (balanced to unbalanced) transformer such as a "Magic Tee" to split the signal between a coaxial cable 34 feeding the patch 12 and a coaxial cable 36 feeding the patch 14. As shown, and as will be readily appreciated by those skilled in the art, the coaxial cable 34 connects to a conductive feed pin 38 which is conductively attached to the conducting plane 18 near the leading apex thereof. In similar fashion, the coaxial cable 36 interconnects with a feed pin 40 which is connected to the conducting plane 24 near the leading apex thereof. The points of interconnection of the feed pins 38, 40 with the respective conducting planes 18, 24 lie on a line interconnecting the apexes of those planes which are in juxtaposition to each other. It will be appreciated that the input signal is connected to the conducting planes at leading points furthest from the back sides of those planes which are connected by respective ground planes 22, 28 to the ground plane 16. The shields of the coaxial cables 34, 36 are also connected to the ground plane 16. With such an arrangement, when an input signal is fed to the balun transformer 32, the input to the two patches 12, 14 are of equal amplitude, but 180° out of phase. Accordingly, as shown in FIG. 3., the superimposed radiated far field components, from the four slots 21, 23, 25, 27 which are parallel to the conducting planes (Y components) and parallel to the line intersecting the apexes of these planes are in phase and are additive, while the radiated field components perpendicular to the conducting planes (Z components) and perpendicular to the line interconnecting the apexes of those conducting planes (X components) are out of phase and cancel each other. As is well known to those skilled in the art, it is the radiated field component parallel to the conducting planes and parallel to the line through the apexes of those conducting planes which is in phase and is transmitted.

Since the radiating frequency of a microstrip antenna such antenna as that presented, is generally determined by the physical configuration of the patch acting as a transmission line conducting energy from the feed pin to the slots, it will be understood that any input frequency can be placed at the input of the antenna 10 and the signal will appear to radiate from points, within the slots, that are separated by one half wavelength. The triangular nature of the patches accommodates a broad band or spectrum of frequencies, since a broad range of requisite separations exists. Indeed, the radiating slots of the antenna are separated by a variable distance.

Thus it can be seen that the objects of the invention have been satisfied by the structure presented above. While in accordance with the patent statues only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A microstrip antenna, comprising:

first and second triangular conductive planes;

a ground plane spaced from said conductive planes;

a dielectric material interposed between said conductive planes and said ground plane;

wherein radiating slots are formed by said triangular conductive planes and said ground plane; and wherein sides of said first triangular conductive plane are parallel to respective sides of said second triangular conductive plane, an apex of said first triangular conductive plane is in juxtaposition to an apex of said second triangular conductive plane, feed pins connected to a signal source are connected to said conductive planes at said apexes of said first and second conductive planes, and said signal source presents a first signal to a first conductive plane which is 180° out of phase from a second signal presented to a second conductive plane.

2. The microstrip antenna according to claim 1, wherein said first and second conductive planes are connected to said ground plane at sides opposite said apexes to which said signal source is connected.

3. The microstrip antenna according to claim 1, wherein said first and second conductive planes and ground plane are parallel to each other.

4. A microstrip antenna, comprising:

a signal source;

a first triangular conductive plane having an apex connected to said signal source;

a second triangular conductive plane having an apex connected to said signal source;

said first and second triangular conductive planes having respective sides parallel to each other;

a ground plane;

wherein sides of said conductive planes opposite said apexes are connected to said ground plane;

radiating slots between said triangular conductive planes and said ground plane; and wherein said signal source provides signals to said first triangular conductive plane which are of equal amplitude, but 180° out of phase from signals provided to said second triangular conductive plane.

5. The microstrip antenna according to claim 4, wherein said first and second triangular conductive planes are parallel to said ground plane and equally spaced therefrom.

6. The microstrip antenna according to claim 5, wherein said first and second triangular conductive planes are of equal size.

7. The microstrip antenna according to claim 6, further comprising a dielectric interposed between said ground plane and said first and second conductive planes.

* * * * *